US007708269B2

(12) United States Patent
Nakashima et al.

(10) Patent No.: US 7,708,269 B2
(45) Date of Patent: May 4, 2010

(54) SHEET FEEDING DEVICE AND IMAGE FORMING APPARATUS

(75) Inventors: Akira Nakashima, Kyoto (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 399 days.

(21) Appl. No.: 11/362,061

(22) Filed: Feb. 27, 2006

(65) Prior Publication Data

US 2006/0192331 A1 Aug. 31, 2006

(30) Foreign Application Priority Data

Feb. 28, 2005 (JP) ..... 2005-053837

(51) Int. Cl.
*B65H 1/00* (2006.01)
*B65H 1/22* (2006.01)

(52) U.S. Cl. ..... 271/164; 271/162

(58) Field of Classification Search ..... 271/147, 271/157, 167, 164, 162, 145
See application file for complete search history.

(56) References Cited

U.S. PATENT DOCUMENTS 4,940,220 A * 7/1990 Van Mechelen ..... 271/2
5,335,903 A * 8/1994 Martin et al. ..... 271/157
5,364,088 A * 11/1994 Maruyama et al. ..... 271/164
5,405,130 A * 4/1995 Maass ..... 271/147
5,593,152 A * 1/1997 Wirth et al. ..... 271/241
5,813,670 A * 9/1998 Maass ..... 271/157
6,776,405 B2 * 8/2004 Eskey ..... 271/9.08
6,805,344 B2 * 10/2004 Abe et al. ..... 271/157
2004/0041334 A1 * 3/2004 Yoshihara ..... 271/145
2004/0154896 A1 * 8/2004 Braford, Jr. ..... 192/201
2006/0244202 A1 * 11/2006 Herrmann et al. ..... 271/147

FOREIGN PATENT DOCUMENTS

GB 2019366 * 10/1979
JP 62-47536 U 3/1987
JP 01053937 * 3/1989
JP 09-255169 A 9/1997
JP 11-208902 A 8/1999
JP 11324475 * 11/1999
JP 2000-335753 A 12/2000
JP 2003-267565 A 9/2003
JP 2004-256247 A 9/2004

* cited by examiner

*Primary Examiner*—Patrick Mackey
*Assistant Examiner*—Patrick Cicchino
(74) *Attorney, Agent, or Firm*—Birch, Stewart, Kolasch & Birch, LLP

(57) ABSTRACT

A sheet feeding device includes a stacking plate, a sheet stacker, and a damping member. The stacking plate is liftably supported in the sheet stacker and is adapted for sheets to be fed into a sheet processing apparatus to be stacked thereon. The sheet stacker is adapted to be movable between a housed position where the stacker is housed in a housing and an exposed position where the stacking plate is exposed outside of the housing. The damping member is adapted to exert on the sheet stacker a damping force according to moving speed of the sheet stacker, thereby limiting the moving speed.

9 Claims, 5 Drawing Sheets

SHEET FEEDING DEVICE AND IMAGE FORMING APPARATUS

CROSS REFERENCE

This Nonprovisional application claims priority under 35 U.S.C. §119(a) on patent application Ser. No. 2005-053837 filed in Japan on Feb. 28, 2005, the entire contents of which are hereby incorporated by reference.

BACKGROUND OF THE INVENTION

The present invention relates to sheet feeding devices, such as large capacity cassettes (hereinafter merely referred to as LCCs), adapted for use in sheet processing apparatus, such as image forming apparatus, to store therein a large number of sheets to be fed into the apparatus. The present invention further relates to image forming apparatus provided with such sheet feeding devices.

Conventional sheet feeding devices are positioned beside sheet processing apparatus for storing sheets of a size that is most frequently used therein. For example, LCCs adapted for use in copying machines as image forming apparatus generally have a capacity of approximately 2,000 sheets of A4-size plain paper placed in landscape orientation.

Designed for multipurpose use and to perform various functions such as of printing or facsimile communication, recent image forming apparatus tend to handle an increasing number of sheets of various sizes and types.

In light of the foregoing, there have been developed LCCs with a capacity of 4,000 or more sheets of various sizes. With 4,000 to 5,000 sheets of A3-size plain paper stored therein, such LCCs have a total weight of approximately 100 kg.

On the other hand, there has been strong demand for smaller and lighter image forming apparatus. Suppose an image forming apparatus is provided with an LCC. The LCC includes a sheet stacker for stacking sheets, and the sheet stacker is removable from a housing of the LCC. When the sheet stacker with a large number of sheets stacked therein is pulled out of, or pushed into, the housing, the impact of collision between the sheet stacker and the housing causes the image forming apparatus to vibrate or move. Such vibration or movement causes components inside the image forming apparatus to become loosely mounted or prevents the image forming apparatus from being maintained in a horizontal position.

To solve the foregoing problems, JP H11-208902A discloses an LCC that has an elastic member arranged in a housing so as to face a rear side surface of a sheet stacker. The elastic member is intended to cushion an impact of collision caused between the housing and the sheet stacker when the stacker is moved. JP 2003-267565A discloses an LCC that has a housing with an openable upper surface. The openable upper surface allows access to a sheet stacker from above, thereby eliminating the need to remove the sheet stacker from the housing for sheet replenishment or any other operation.

However, it is hard to determine an optimum shape, material, size, etc., for the elastic member in order to ensure that the elastic member cushions the impact of collision between the housing and the sheet stacker. Also, the construction as disclosed in JP 2003-267565A involves complicated arrangement of sheet feeding members and also makes it difficult to stack sheets in the sheet stacker without causing damage, such as bent corners, to the sheets.

A feature of the invention is to provide an LCC that ensures that a collision impact on a sheet processing apparatus is cushioned with a damping member provided in a sheet stacker. The damping member is adapted to act on the sheet stacker a damping force according to moving speed of the sheet stacker as being moved in and out of a housing of the LCC. Another feature of the invention is to provide an image forming apparatus that prevents components therein from becoming loosely mounted and is allowed to be maintained in a horizontal position.

SUMMARY OF THE INVENTION

A sheet feeding device of the invention includes a stacking plate, a sheet stacker, and a damping member. The stacking plate is liftably supported in the sheet stacker and is adapted for sheets to be fed into a sheet processing apparatus to be stacked thereon. The sheet stacker is adapted to be movable between a housed position where the sheet stacker is housed in a housing and an exposed position where the sheet stacker is exposed outside of the housing. The damping member is adapted to exert on the sheet stacker a damping force according to moving speed of the sheet stacker.

DETAILED DESCRIPTION OF THE INVENTION

Figure 1:
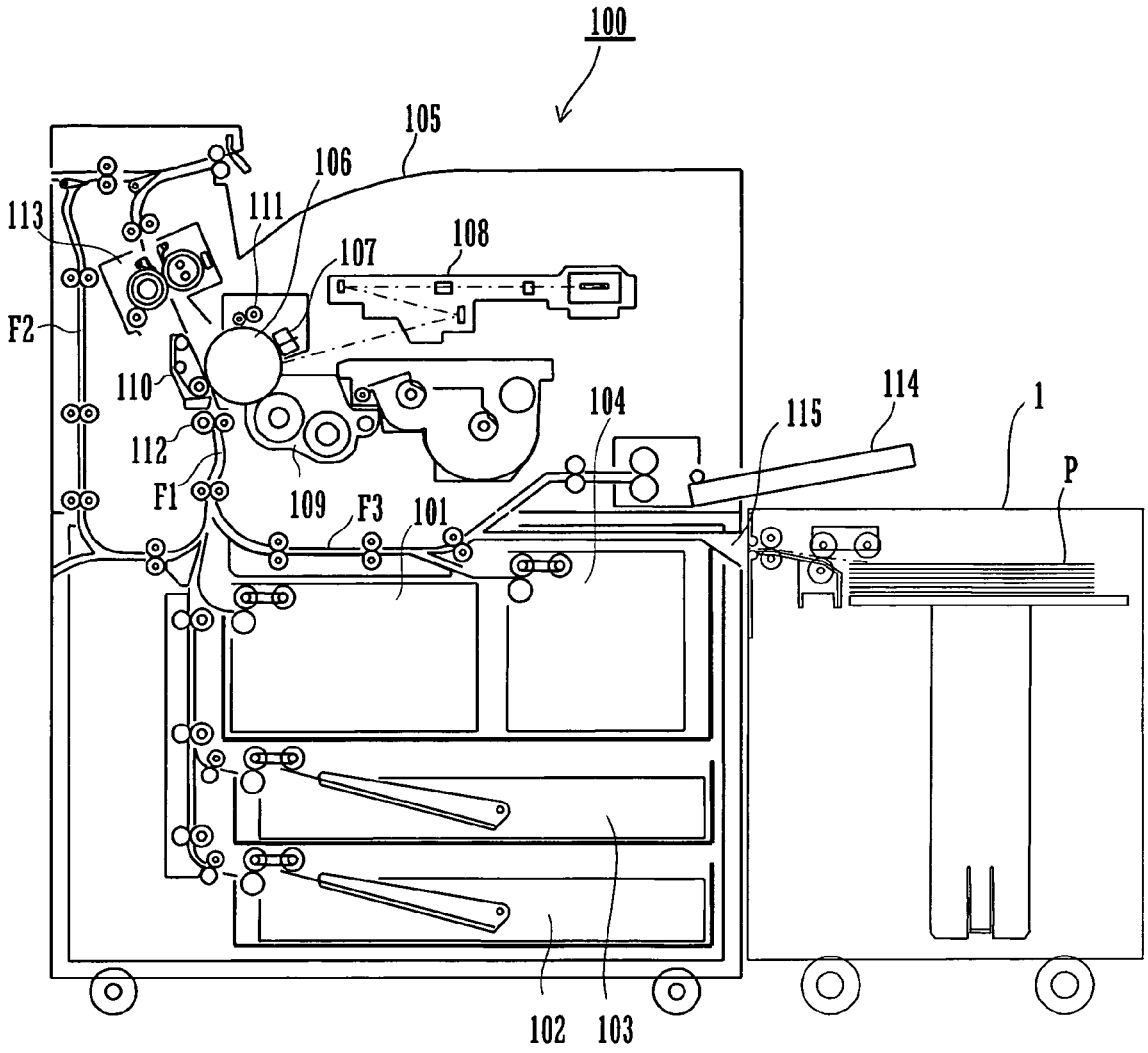
FIG. 1 is a schematic cross-sectional view of an image forming apparatus as a sheet processing apparatus into which an LCC according to an embodiment of the invention is to feed sheets.

Referring to the accompanying drawings, embodiments of the invention are described below. Referring to FIG. 1, an LCC 1 as the sheet feeding device of the invention is arranged beside an image forming apparatus 100 as a sheet processing device of the invention. Instead of the single LCC 1 in a first embodiment, a plurality of LCCs may be arranged in alignment with one another. The LCC 1 feeds a sheet P of paper, or another material such as OHP film, into the image forming apparatus 100.

The image forming apparatus 100 forms an image on the sheet P by performing an electrophotographic image forming process. The image forming apparatus 100 has sheet cassettes 101 to 104 and a sheet output tray 105 in a bottom portion and a top portion thereof, respectively. A sheet transport path F1 is provided so as to lead from the sheet cassettes 101 to 103 to the sheet output tray 105. A photoreceptor drum 106 is positioned close to the sheet transport path F1. Around the photoreceptor drum 106 arranged are a charging device 107, an optical scanning unit 108, a developing unit 109, a transferring device 110, a cleaning unit 111, and the like.

Registration rollers 112 are provided upstream of the photoreceptor drum 106 along the sheet transport path F1. The registration rollers 112 feed the sheet P to a transfer area located between the photoreceptor drum 106 and the transferring device 110 in synchronization with rotation of the photoreceptor drum 106. A fusing device 113 is provided downstream of the photoreceptor drum 106 along the sheet transport path F1.

The charging device 107 applies a predetermined level of electrostatic charge to a circumferential surface of the photoreceptor drum 106. The optical scanning unit 108 forms an electrostatic latent image on the circumferential surface of the photoreceptor drum 106 based on image data. The developing unit 109 supplies toner to the circumferential surface and develops the electrostatic latent image into a toner image. The transferring device 110 transfers the toner image as formed on the circumferential surface to the sheet P. The fusing device 111 fixes the toner image onto the sheet P. The sheet P with the toner image fixed thereto is output to the sheet output tray 105. The cleaning unit 111 removes and collects residual toner that remains on the circumferential surface after the transfer operation is completed.

The image forming apparatus 100 is also provided with a switchback transport path F2 and a sheet transport path F3. In a duplex image forming process in which an image is formed on each side of sheet P, the sheet P with an image formed on a first side is transported on the switchback transport path. F2 to the transfer area with the first side and a second side reversed. Sheets fed from each of the sheet cassette 104, a manual feeding tray 114, and a sheet receiving section 115 are transported on the sheet transport path F3. The tray 114 is provided on a side surface of the image forming apparatus 100 for feeding sheets of various sizes. The section 115 is provided for receiving sheets fed from the LCC 1. The path F3 extends approximately horizontally so as to join, at one end, the path F1 at an upstream point of the registration rollers 112 and be divided, at the other end, to lead to each of the sheet cassette 104, the tray 114, and the section 115.

Figure 2:
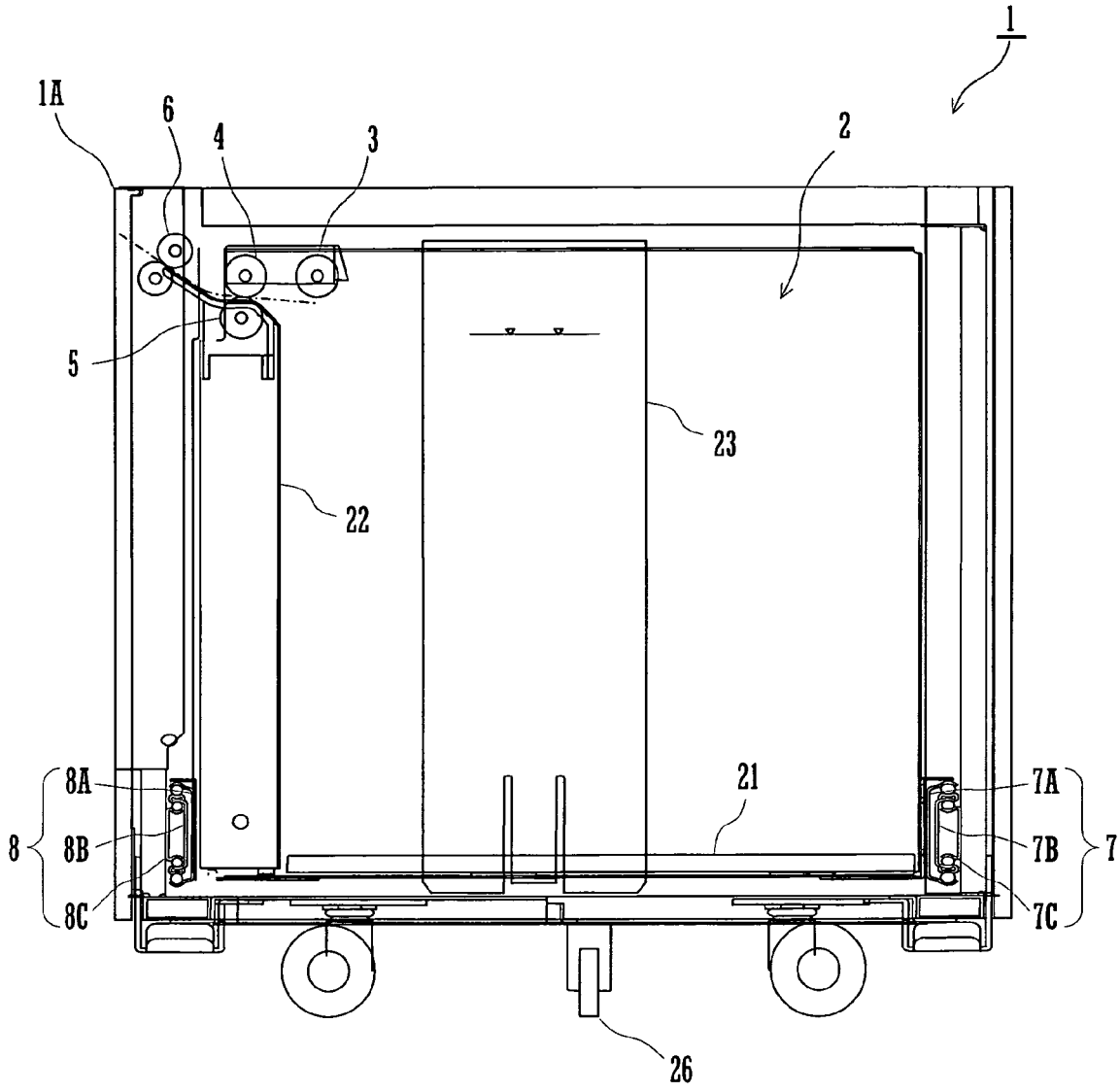
FIG. 2 is a schematic front cross-sectional view of the LCC.

Referring to FIG. 2, the LCC 1 includes a housing 1A, a sheet stacker 2, a pick-up roller 3, a feeding roller 4, a reversing roller 5, and transporting rollers 6.

The sheet stacker 2 has a stacking plate 21, a front guiding plate 22, side guiding plates 23 and 24, and a rear guiding plate. The side guiding plate 24 and the rear guiding plate are not shown in the figure. Held in a horizontal position, the stacking plate 21 is provided for a plurality of sheets to be stacked thereon. The sheets as stacked are positioned by the front guiding plate 22, the side guiding plates 23 and 24, and the rear guiding plate.

The pick-up roller 3 is supported pivotably about a rotary shaft for the feeding roller 4 between an upper position and a lower position. The pick-up roller 3 picks up a top one of sheets stacked on the stacking plate 21 in order to lead the top sheet between the feeding roller 4 and the reversing roller 5.

The rollers 4 and 5 are both rotated clockwise in FIG. 2 to allow passage of the sheet therebetween. In a case where multiple sheets are picked up at a time and led between the rollers 4 and 5 by the roller 3, only a top one of the sheets are brought into contact with the roller 4 and led to the transporting rollers 6. The rest of the sheets are returned to the stacking plate 21 by the reversing roller 5.

The LCC 1 has a capacity of a large number of sheets (approximately 5,000 sheets in the present embodiment) of various sizes such as of A3, B4, A4, and B5.

The side guiding plates 23 and 24 are rendered movable on the stacking plate 21 within a predetermined range from frontward to rearward, and vice versa, of the LCC 1. More specifically, the plates 23 and 24 are rendered movable in two opposite directions perpendicular to a sheet feeding direction. Movement of one of the plates 23 and 24 in one of the two directions is transmitted to the other, so that the other is moved in the opposite direction. Accordingly, sheets stacked on the-stacking plate 21 are positioned approximately at the center of the stacking plate 21 along the opposite directions. In addition, the rear guiding plate is rendered movable within a predetermined range from side to side of the LCC 1, i.e., movable along the sheet feeding direction.

The sheet stacker 2 has a lifting motor in the rear side surface. Rotation of the lifting motor is transmitted through wire, so that the stacking plate 21 is lifted up and down along a not-shown guiding shaft while being held in a horizontal position.

Inside the LCC 1, there are provided slide rail assemblies 7 and 8. The slide rail assembly 7 includes a sliding member 7A, an intermediate member 7B, and a fixed member 7C. The slide rail assembly 8 includes a sliding member 8A, an intermediate member 8B, and a fixed member 8C. The sliding members 7A and 8A are attached to the right and left outer side surfaces of the sheet stacker 2, respectively. The fixed members 7C and 8C are attached to the right and left inner side surfaces of the housing 1A, respectively.

There are ball bearings arranged between the sliding member 7A and the intermediate member 7B and between the intermediate member 7B and the fixed member 7C, respectively. The sliding member 7A is slidable from frontward to rearward, and vice versa, of the LCC 1 with respect to the intermediate member 7B. Further, the intermediate-member 7B is slidable from frontward to rearward, and vice versa, of the LCC 1 with respect to the fixed member 7C. The slide rail assembly 8 has a similar construction to that of the assembly 7. The slide rail assemblies 7 and 8 allow the sheet stacker 2 to be detachably housed in the housing 1A. The sheet stacker 2 is movable between a housed position and an exposed position. In the housed position, the sheet stacker 2 is housed, and the stacking plate 21 is concealed, in the housing 1A. In the exposed position, the entire stacking plate 21 is exposed at the front of the housing 1A.

At a front portion of a bottom surface thereof, the sheet stacker 2 has a wheel 26 mounted rotatably. When the sheet stacker 2 is in the housed position, a circumferential surface of the wheel 26 is out of contact with a floor surface. In the course of the sheet stacker 2 being moved from the housed position to the exposed position, the circumferential surface is brought into contact with the floor surface with the weight of the sheet stacker 2.

When the sheet stacker 2 is pulled out from the housed position to the exposed position, the sliding member 7A together with the intermediate member 7B is first slid frontward with respect to the fixed member 7C. Then, when the sheet stacker 2 is still pulled after the intermediate member 7B is slid a maximum sliding distance with respect to the fixed member 7C, the sliding member 7A is slid further frontward with respect to the intermediate member 7B. Thus, a maximum pullout distance of the sheet stacker 2 is a sum of the maximum sliding distance of the intermediate member 7B with respect to the fixed member 7C and a maximum sliding distance of the sliding member 7A with respect to the intermediate member 7B.

When the sheet stacker 2 is pushed in from the exposed position to the housed position, the intermediate member 7B is first slid with respect to the fixed member 7C, with the sliding member 7A projecting frontward. Then, when the sheet stacker 2 is still pushed after the intermediate member 7B is slid a maximum sliding distance with respect to the fixed member 7C, the sliding member 7A is slid further into the housing 1A with respect to the intermediate member 7B. The slide rail assembly 8 is slid in a similar manner when the sheet stacker 2 is pulled out or pushed in.

Figure 3:
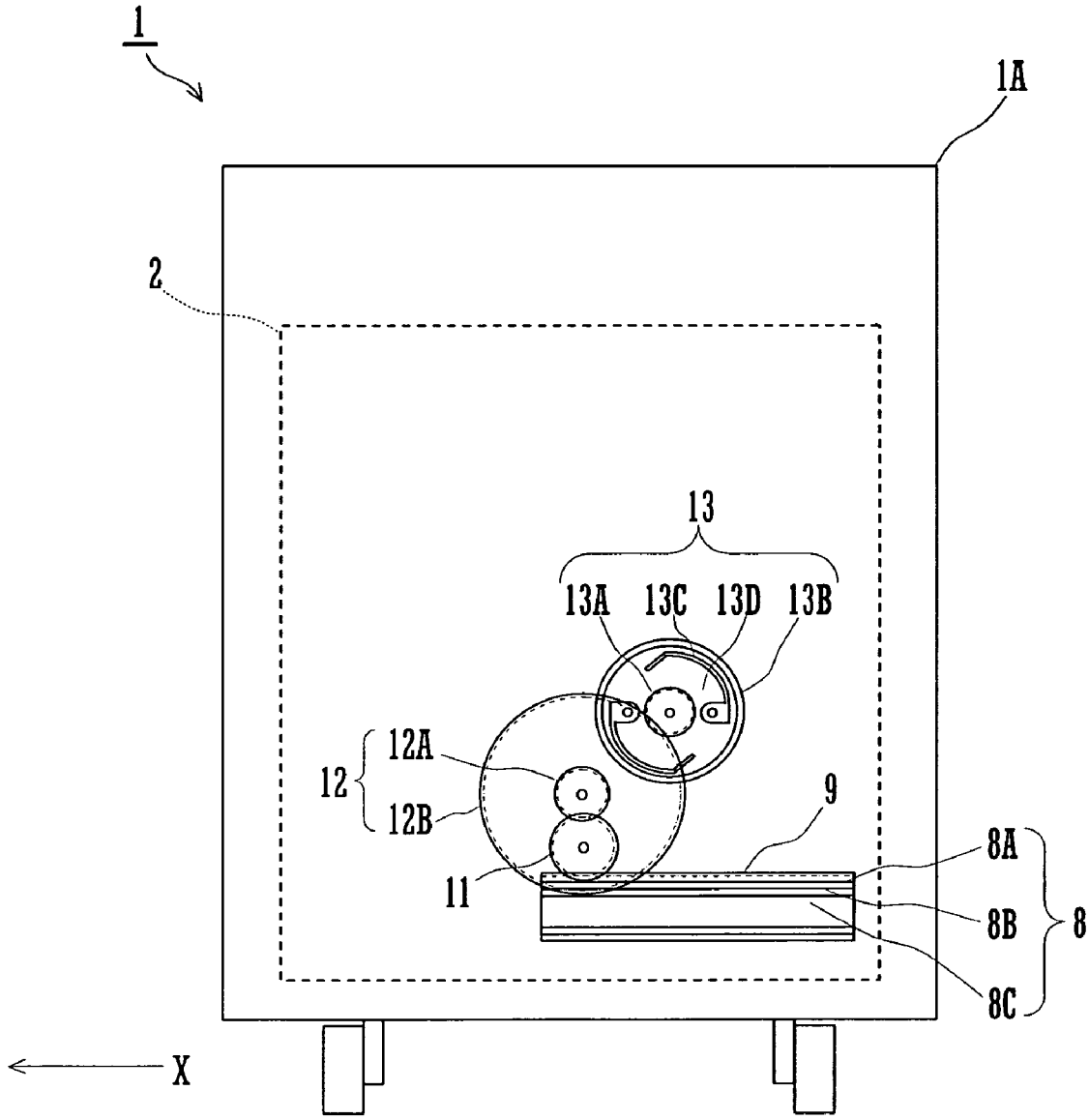
FIG. 3 is a schematic side cross-sectional view of the LCC with a sheet stacker in a housed position.
Figure 4:
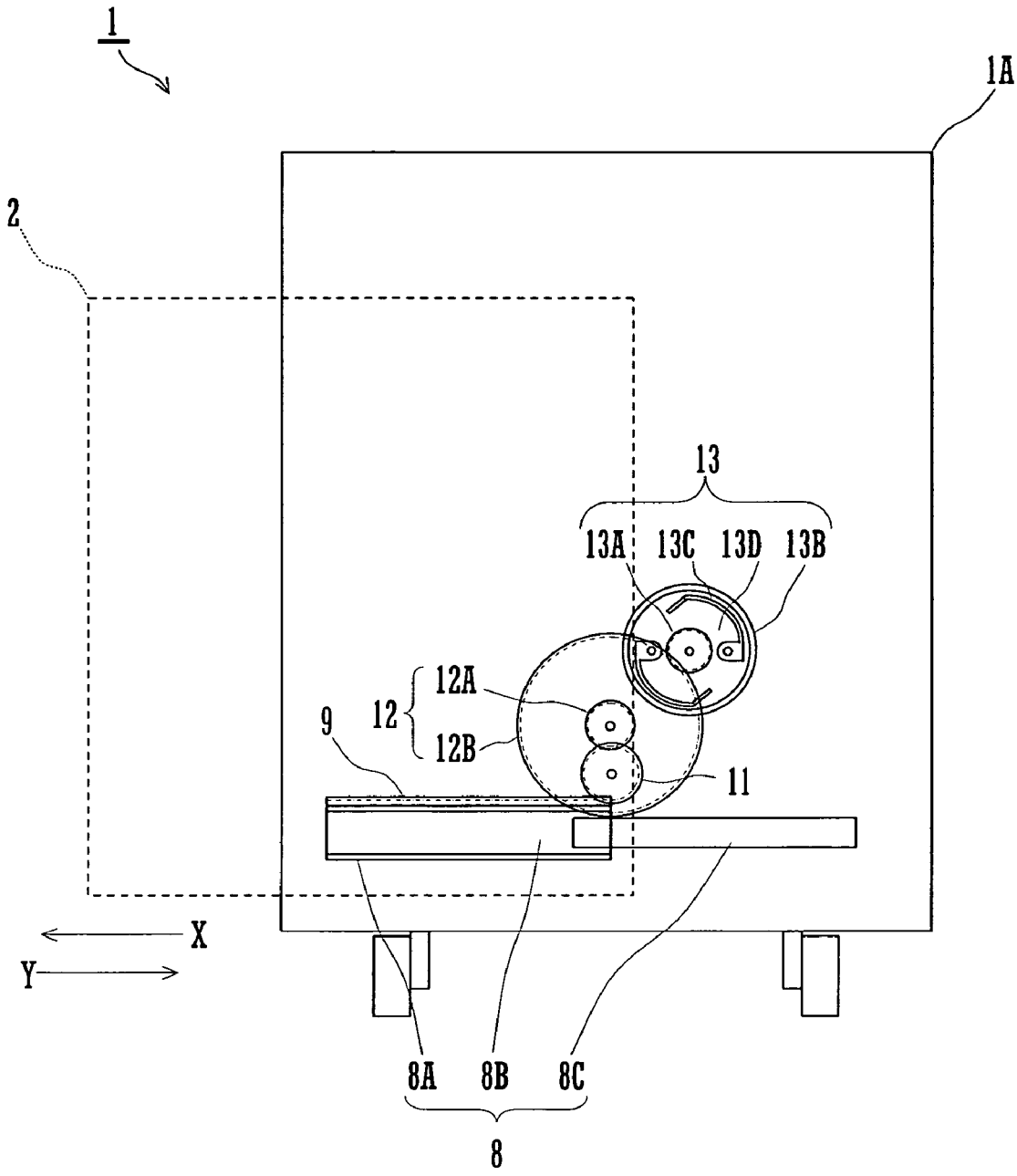
FIG. 4 is a schematic side cross-sectional view of the LCC in the course of the sheet stacker being moved between the housed position to an exposed position.
Figure 5:
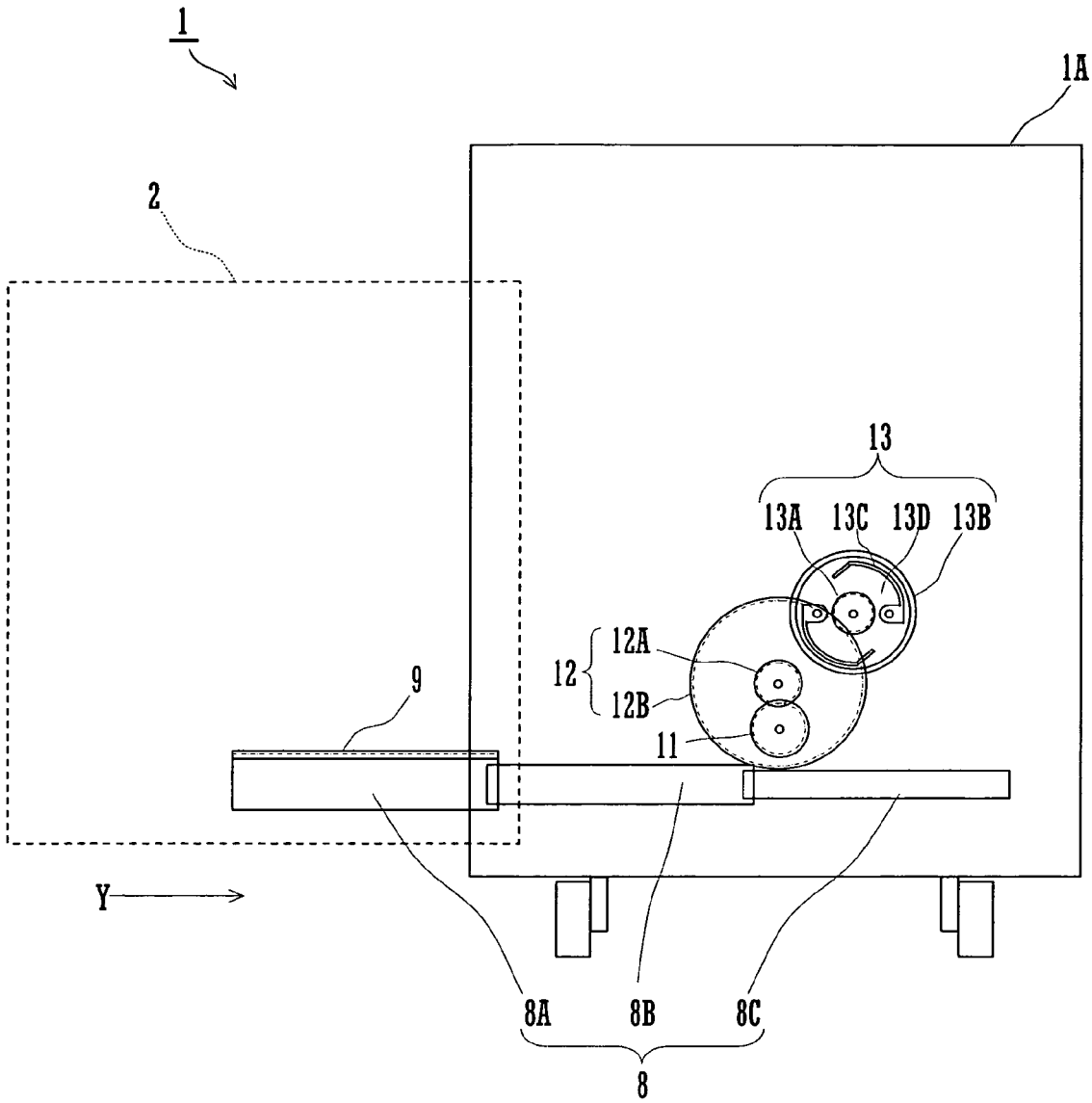
FIG. 5 is a schematic side cross-sectional view of the LCC with the sheet stacker in the exposed position.

FIGS. 3 to 5 are schematic side cross-sectional views of the LCC 1. Illustrated in FIGS. 3 to 5 is the sheet stacker 2 in the housed position, in the course of being moved between the housed position and the exposed position, and in the exposed position, respectively.

A pinion gear 11 and an intermediate gear 12 are rotatably mounted on the left inner side surface of the housing 1A. A centrifugal clutch 13 is also mounted on the left inner side surface.

The maximum pullout distance of the sheet stacker 2 is a sum of-a maximum sliding-distance of the intermediate member 8B with respect to the fixed member 8C and a maximum sliding distance of the sliding member 8A with respect to the intermediate member 8B. The maximum pullout distance is approximately equal to length of the sheet stacker 2 as measured along a moving direction thereof, i.e., depth of the sheet stacker 2. Also, the maximum sliding distance of the intermediate member 8B with respect to the fixed member 8C is approximately equal to the maximum sliding distance of the sliding member 8A with respect to the intermediate member 8B. Therefore, full length of the slide rail assembly 8 as measured along the moving direction is approximately half of the depth of the sheet stacker 2. The sliding member 8A is positioned so as to extend rearward from an approximately horizontally central portion of the left outer side surface of the sheet stacker 2. The fixed member 8C is positioned so as to extend rearward from an approximately horizontally central portion of the left inner side surface of the housing 1A.

The centrifugal clutch 13 corresponds to the damping member of the invention. The centrifugal clutch 13 includes an input shaft gear 13A, an output shaft 13B, clutch shoes 13C, and a rotatable plate 13D.

The intermediate gear 12 has a small gear 12A and a large gear 12B fixed coaxially to each other. The small gear 12A meshes with the pinion gear 11. The large gear 12B meshes with the input shaft gear 13A. The output shaft 13B is fixed to the left inner side surface of the housing 1A.

A rack gear 9 is formed on an upper surface of the sliding member 8A along the length thereof. The rack gear 9 has teeth that are shaped and pitched so as to mesh with the pinion gear 11. Thus, the rack gear 9 is positioned so as to extend rearward from an approximately horizontally central portion of the left outer side surface of the sheet stacker 2.

The pinion gear 11 is rotatably supported at an approximately horizontally central portion of the left inner side surface of the housing 1A. The positioning of the rack gear 9 allows the gear 9 to mesh with the pinion gear 11 in the beginning of pullout action of the sheet stacker 2 and in the end of housing action of the stacker 2.

The mesh between the rack gear 9 and the pinion gear 11 translates the sliding movement of the slide rail assembly 8 frontward or rearward of the LCC 1 into rotation of the pinion gear 11. The rotation of the pinion gear 11 is transmitted to the input shaft gear 13A through the intermediate gear 12. The rack gear 9 and the pinion gear 11 collectively correspond to the transmitting member of the invention.

Referring back to the centrifugal clutch 13, the clutch shoes 13C are slidably mounted on the rotatable plate 13D. The input shaft gear 13A is fixed to the rotatable plate 13D. When the input shaft gear 13A is spun together with the rotatable plate 13D and the clutch shoes 13C, the shoes 13C are centrifugally slid outward and come into contact with an inner circumferential surface of the output shaft 13B. Friction between the clutch shoes 13C and the output shaft 13B acts as a damping force on the rotatable plate 13D and the input shaft gear 13A, so that the rotation of the pinion gear 11 and the movement of the rack gear 9 are slowed down.

Consequently, the movement of the sheet stacker 2 is also slowed down in the beginning of the pullout action, and in the end of the housing action.

When the sheet stacker 2 is to be pulled out of the housing 1A, more specifically, the damping force acts on the movement of the stacker 2 in the course of the stacker 2 in a position shown in FIG. 3 being pulled out in a direction of arrow X to reach a position shown in FIG. 4 (intitial stage). The damping force does not act on the movement in the course of the stacker 2 in the position shown in FIG. 4 reaching a position shown in FIG. 5.

When the sheet stacker 2 is to be pushed into the housing 1A, in contrast, the damping force does not act on the movement of the stacker 2 in the course of the stacker 2 in the position shown in FIG. 5 being pushed in a direction of arrow Y to reach the position shown in FIG. 4. The damping force acts on the movement in the course of the stacker 2 in the position shown in FIG. 4 reaching the position shown in FIG. 3 (final stage).

Accordingly, even if the sheet stacker 2 in the position shown in FIG. 3 or 5 is pulled out or pushed in with a strong force, the sheet stacker 2 is moved at a comparatively low speed while most portions thereof are positioned inside the housing 1A. This prevents the movement of the sheet stacker 2 from exerting a strong inertial force, or causing a large collision impact, on the housing 1.

Referring back to the centrifugal clutch 13, the centrifugal force that acts on the clutch shoes 13, and the friction caused between the shoes 13 and the output shaft 13D, both depend on the rotation speed of the input shaft gear 13A. In addition, the rotation speed of the input shaft gear 13A is proportional to moving speed of the sheet stacker 2. Thus, a damping force according to the moving speed acts on the sheet stacker 2. More specifically, the movement of the stacker 2 is hardly damped at a low moving speed and strongly damped at a high moving speed.

This ensures that a collision impact on the image forming apparatus 100 is cushioned. This prevents components in the image forming apparatus 100 from becoming loosely mounted and also allows the apparatus 100 to be maintained in a horizontal position.

Alternatively, the pinion gear 11 is mounted on the left inner side surface of the housing 1A at a position more rearward than that as shown in FIG. 3. This positioning contributes to a shortened duration of the damping force acting on the sheet stacker 2. Further alternatively, the rack gear 9 is rendered shorter in order to shorten the duration. Contrary, the rack gear 9 is rendered longer so as to extend more rearward, in order to prolong the duration.

The LCC 1 according to the present embodiment is fit for use not only in the image forming apparatus 100 but also in any sheet processing apparatus that is adapted to perform certain processes to sheets to be fed thereinto from the LCC 1.

Instead of the centrifugal clutch 13 as the damping member in the LCC 1, another device may be used as long as such device exerts on the sheet stacker 2 a damping force according to moving speed of the stacker 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding device adapted for use in a sheet processing apparatus, the sheet feeding device comprising:

a housing;

a stacking plate adapted for sheets to be fed into the sheet processing apparatus to be stacked thereon;

a sheet stacker adapted to support the stacking plate in such a manner that the stacking plate is lifted up and down and to be movable horizontally between a housed position where the sheet stacker is housed in the housing and an exposed position where the stacking plate is exposed outside of the housing;

a damping member adapted to exert on the sheet stacker a damping force according to moving speed of the sheet stacker, between beginning of movement of the sheet stacker from the housed position to the exposed position and end of movement of the sheet stacker from the exposed position to the housed position; and a transmitting member, wherein the damping member is a centrifugal clutch having an input shaft and an output shaft, the output shaft being fixed to the housing, and wherein the transmitting member is adapted to translate the horizontal movement of the sheet stacker into rotation of the input shaft.

2. The sheet feeding device according to claim 1, further comprising:

a slide rail assembly having a fixed member and a sliding member, the fixed member and the sliding member being mounted on the housing and the sheet stacker, respectively, with longitudinal axes of the fixed and sliding members extending parallel to the direction of horizontal movement of the sheet stacker, wherein the transmitting member has a pinion gear and a rack gear, the pinion gear being connected to the input shaft, and the rack gear being mounted on the sliding member so as to mesh with the pinion gear.

3. The sheet feeding device according to claim 2, wherein the centrifugal clutch is adapted to exert the damping force on the sheet stacker in beginning of movement of the sheet stacker from the housed position to the exposed position and in end of movement of the sheet stacker from the exposed position to the housed position.

4. The sheet feeding device according to claim 3, wherein the pinion gear is rotatably supported at an approximately horizontally central portion of the housing, and wherein the rack gear is positioned so as to extend rearward from an approximately horizontally central portion of the sheet stacker.

5. An image forming apparatus provided with an image forming unit adapted to form an image on a sheet, the image forming apparatus comprising:

a casing;

a sheet feeding device adapted to be connected to the casing and to feed a sheet into the image forming apparatus, the sheet feeding device including:

a housing, a stacking plate adapted for sheets to be fed into the sheet processing apparatus to be stacked thereon, a sheet stacker adapted to support the stacking plate in such a manner that the stacking plate is lifted up and down and to be movable horizontally between a housed position where the sheet stacker is housed in the housing and an exposed position where the stacking plate is exposed outside of the housing, and a damping member adapted to exert on the sheet stacker a damping force according to moving speed of the sheet stacker, between beginning of movement of the sheet stacker from the housed position to the exposed position and end of movement of the sheet stacker from the exposed position to the housed position; and a transmitting member, wherein the damping member is a centrifugal clutch having an input shaft and an output shaft, the output shaft being fixed to the housing, and wherein the transmitting member is adapted to translate the horizontal movement of the sheet stacker into rotation of the input shaft.

6. The image forming apparatus according to claim 5, wherein the sheet feeding device further comprises a slide rail assembly, the slide rail assembly including a fixed member and a sliding member, the fixed member and the sliding member being mounted on the housing and the sheet stacker, respectively, with longitudinal axes of the fixed and sliding members parallel to the direction of horizontal movement of the sheet stacker, and wherein the transmitting member has a pinion gear and a rack gear, the pinion gear being adapted to be connected to the input shaft, and the rack gear being adapted to be mounted on the sliding member so as to mesh with the pinion gear.

7. The image forming apparatus according to claim 6, wherein the centrifugal clutch is adapted to exert the damping force on the sheet stacker in beginning of movement of the sheet stacker from the housed position to the exposed position and in end of movement of the sheet stacker from the exposed position to the housed position.

8. The image forming apparatus according to claim 7, wherein the pinion gear is rotatably supported at an approximately horizontally central portion of the housing, and wherein the rack gear is positioned so as to extend rearward from an approximately horizontally central portion of the sheet stacker.

9. The image forming apparatus according to claim 5, wherein the sheet feeding device further comprises a slide rail assembly, the slide rail assembly including a fixed member and a sliding member, the fixed member and the sliding member being mounted on the housing and the sheet stacker, respectively, with longitudinal axes of the fixed and sliding members parallel to the direction of horizontal movement of the sheet stacker, and wherein the transmitting member has a pinion gear and a rack gear, the pinion gear being adapted to be disposed to transmit a rotation thereof to the input shaft, the rack gear being adapted to be mounted on the sliding member so as to mesh with the pinion gear.

* * * * *